US006601965B2

(12) United States Patent
Kamara

(10) Patent No.: US 6,601,965 B2
(45) Date of Patent: Aug. 5, 2003

(54) JEWELRY WITH BATTERY-ILLUMINATED MEDALLION

(75) Inventor: Michael A. Kamara, Sherman Oaks, CA (US)

(73) Assignee: Firejewel, LLC, Rockville, MD (US)

( * ) Notice: Subject to any disclaimer, the term of this patent is extended or adjusted under 35 U.S.C. 154(b) by 89 days.

(21) Appl. No.: 09/827,028

(22) Filed: Apr. 4, 2001

(65) Prior Publication Data

US 2001/0055205 A1 Dec. 27, 2001

Related U.S. Application Data

(63) Continuation-in-part of application No. 09/498,523, filed on Feb. 4, 2000, now abandoned.

(51) Int. Cl.[7] ..... F21V 21/08

(52) U.S. Cl. ..... 362/104; 362/252

(58) Field of Search ..... 362/104, 252, 362/103, 227, 249, 250, 251

(56) References Cited

U.S. PATENT DOCUMENTS

| | | | | | |
|---|---|---|---|---|---|
| 4,262,324 | A | * | 4/1981 | Murphy | 362/104 |
| 4,779,172 | A | * | 10/1988 | Jimenez et al. | 362/104 |
| 5,477,433 | A | * | 12/1995 | Ohlund | 362/104 |
| 6,122,933 | A | * | 9/2000 | Ohlund | 362/104 |
| 6,296,364 | B1 | * | 10/2001 | Day et al. | 362/104 |

* cited by examiner

*Primary Examiner*—Alan Cariaso
*Assistant Examiner*—Ismael Negron
(74) *Attorney, Agent, or Firm*—Lieberman & Brandsdorfer, LLC

(57) ABSTRACT

A necklace or bracelet includes a luminous medallion. A conductor having a coating of non-conductive material is formed into a loop having two discontinuities. A clasp that houses a removable battery is fixed within the first discontinuity and a bead having an internally embedded LED is located within the second discontinuity. Electrical connections are made to electrodes located within the clasp by interior electrical conductors exposed at the stripped ends of the coated conductors that define one discontinuity. The conductors are fixed in electrical contact with the LED at the other discontinuity at the stripped ends of the coated conductor in the region of the second discontinuity.

13 Claims, 2 Drawing Sheets

JEWELRY WITH BATTERY-ILLUMINATED MEDALLION

REFERENCE TO RELATED APPLICATION

The present application is a continuation-in-part of U.S. patent application Ser. No. 09/498,523 of Michael A. Kamara filed Feb. 4, 2000 now abandoned and entitled "Jewelry With Battery-Illuminated Medallion".

BACKGROUND

1. Field of the Invention

The present invention relates to jewelry. More particularly, this invention pertains to a necklace or bracelet that includes an illuminated medallion.

2. Description of the Prior Art

There exists a substantial market for jewelry of a whimsical nature. Unfortunately, the design of jewelry that can be sold at mass market prices while offering an eye catching effect, such as artificial luminance, is complex and difficult. To achieve such an effect, the jewelry must include a power source, preferably compact. In addition, inexpensive prior art jewelry incorporating a battery-powered device has generally been of limited useful life since inexpensive designs fail to permit battery replacement.

SUMMARY OF THE INVENTION

The present invention addresses the foregoing and other shortcomings of the prior art by providing an article of jewelry. Such article includes an elongated flexible conductor having an exterior coating of non-conductive composition. The conductor comprises a loop having first and second internal discontinuities. A clasp is located within the first discontinuity and a medallion is located within the second discontinuity. The clasp includes a battery in electrical communication with the conductor and the medallion includes an electro-luminous device in electrical communication with the conductor.

The preceding and other features and advantages of the present invention shall become further apparent from the detailed description that follows. Such description is accompanied by a set of drawing figures in which numerals, corresponding to those of the written description, are associated with the features of the invention. Like numerals refer to like features throughout both the written description and the drawing figures.

DETAILED DESCRIPTION OF THE PREFERRED EMBODIMENT

Figure 1:
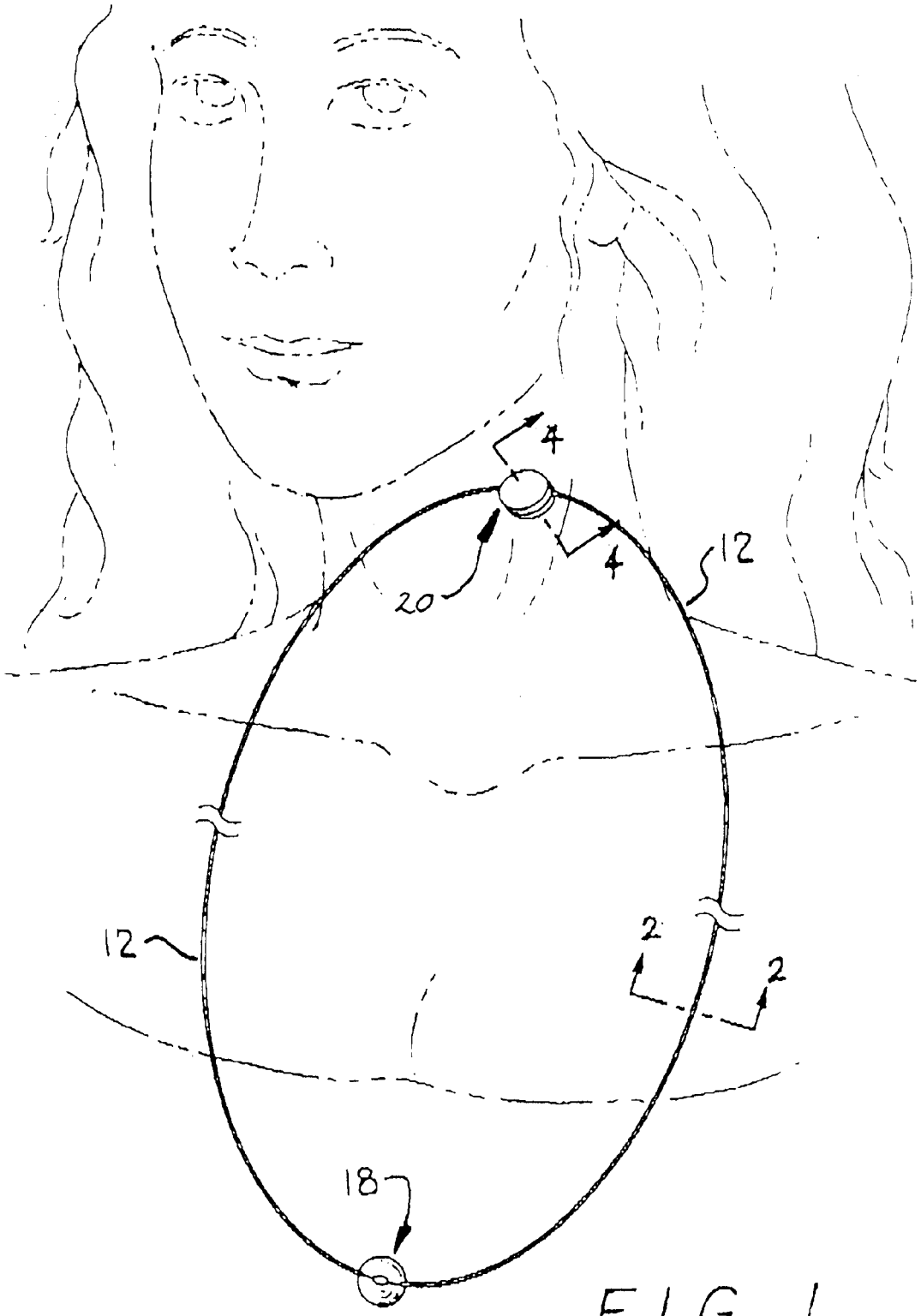
FIG. 1 is a perspective view of a necklace incorporating the invention superimposed upon a wearer shown in shadow outline.
Figure 2:
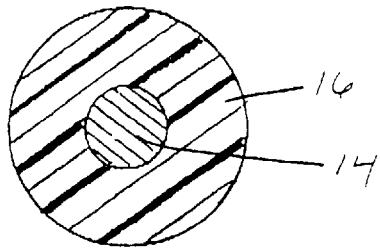
FIG. 2 is a cross-sectional view of the coated conductor of the invention.

Turning to the drawings, FIG. 1 is a perspective view of a necklace 10 incorporating the invention superimposed upon a wearer shown in shadow outline. The necklace 10 generally comprises a coated conductor 12 comprising, as shown in the cross-sectional view of FIG. 2, an internal conductor or wire 14 having a coating 16 of appropriate non-conductive material. An example of a suitable coated conductor is NYLON-coated wire. Such a conductor has the advantageous quality of avoiding "kinking" when bent.

Returning to FIG. 1, the coated conductor 12 is formed into a loop for hanging about a wearer's neck (in the case of the necklace) or wrist (in the case of a bracelet) with discontinuities provided for incorporation of an illuminated medallion 18 and a clasp 20 housing a battery structure. As will be seen, an electrical circuit is formed that includes the battery housed within the clasp 20, a battery-powered light emitting device of the medallion 18 and the conductor 14. Such electrical circuit actuates the medallion to emit illumination when energized by the closing of the clasp 20. Thus the clasp 20 serves both to secure the necklace 10 and to house a replaceable battery. By allowing battery replaceability, the useful life of the necklace 10 is not limited by that of the battery, permitting the fabrication of higher quality jewelry as opposed to the lower quality "throw away" items of the prior art.

Figure 3:
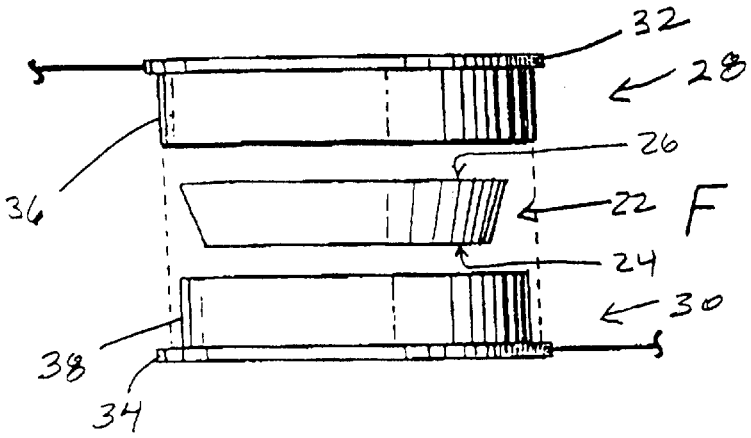
FIG. 3 is an exploded side elevation view of the clasp of an article of jewelry in accordance with the invention.
Figure 4:
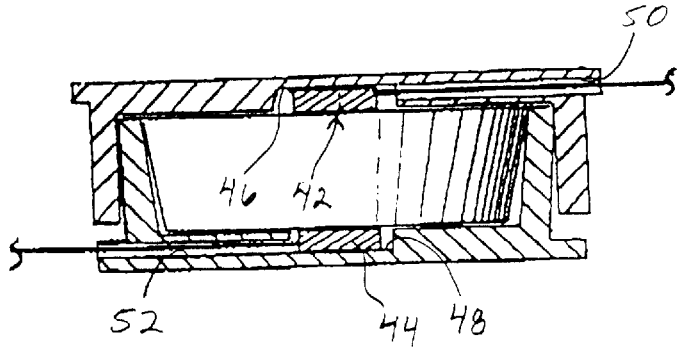
FIG. 4 is an side elevation view in cross-section of an assembled clasp in accordance with the invention.

FIG. 3 is an exploded side elevation view of the clasp 20 of the invention and FIG. 4 is a side elevation view in cross-section of the clasp 20 when the assembly is closed. The clasp 20 has been carefully designed to facilitate the ready removal and replacement of a battery 22 that provides the power for illuminating the medallion 18. The battery 22 is preferably of the nickel cadmium type characterized by an anode surface 24 of lesser diameter than the cathode surface 26.

The clasp 20 includes coating upper and lower caps 28 and 30, respectively. The caps are preferably made of molded plastic or other resilient material. The caps 28 and 30 of the clasp 20 are particularly designed to facilitate easy access to the interior of the chamber formed therebetween for removal and/or replacement of battery 22. Each cap 28 and 30 includes a rim 32 and 34, respectively, that protrudes outside the outer diameter of an associated sidewall. In the case of the upper cap 28, the rim 32 protrudes outside the outer diameter of an annular sidewall 36, while in the case of the lower cap 30, the rim 34 protrudes outside the outer diameter of a sidewall 38.

The rims 32 and 34 greatly facilitate the ability of one to grasp the caps 28 and 30 independently. In addition, as can best be seen in FIG. 4, the clasp 20 has been carefully dimensioned so that, when closed, the sidewall 38 of the lower cap 30 is forced outwardly by the maximum outer diameter of the enclosed battery 22 so that a press-fit is obtained with the interior of the sidewall 35 of the upper cap 28. Such interaction is obtained by careful dimensioning of the inner diameter of the sidewall 38 with the dimensions of the battery 22 and the outer diameter of the sidewall 38 with the inner diameter of the sidewall 36.

In addition to the locking arrangement illustrated in FIG. 4, a tight pressure fit exists between the battery 22 and the interior of the rim 34 of the lower cap 30 that retains the battery 22 within the clasp 20, even when the two caps 28 and 30 are disengaged from one another. This permits one to use and wear the device as an ordinary piece of jewelry, unlocking the clasp 20 to remove the necklace, for example, from one's neck without concern that the battery 22 will be lost.

When appropriate (i.e. when battery replacement is required) this is easily accomplished by pushing a thin rod-like element upward through an aperture (not shown) that is provided extending through a bottom surface of the lower cap within the thickened central area of the rim 34 circumscribed by the inner circumference of the sidewall 38.

Electrodes 42, 44 are received within central recesses 46, 48 at the thickened inner surfaces of the rims 32 and 34 respectively. Each of the rims 32 and 34 includes a tunnel 50, 52 for receiving an end of the coated conductor 12 adjacent a loop discontinuity. Referring to FIG. 4 in particular, it can be seen that the portions of the ends of the coated conductor 12 interior to the rims 32 and 34 are stripped to expose the conductor wire 14. The wire 14 is, in each case, joined to an electrode 42 or 44, after being threaded through one of the tunnels 50, 52 by crimping with a metal crimp bead to form a flat, square contact that cannot traverse backward through the tunnel 50 or 52 as each bead assembly is much larger than the tunnel through which it was originally received. As a result, no adhesives (for securing either electrodes or wires) are required within the interior of the clasp 20.

Figure 5:
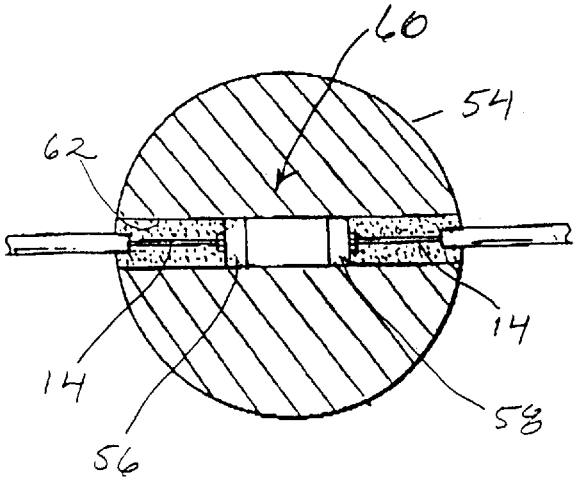
FIG. 5 is a cross-sectional view of the luminous medallion of the invention.

FIG. 5 is a cross-sectional view of the medallion 18 of the necklace 10. The medallion 18 comprises a spherical bead 54, smooth or faceted, of transparent or translucent, clear or tinted, material that receives ends of the coated conductor 12 in the region of a second loop discontinuity. The ends of the coated conductor 12, stripped to expose the interior conductor wire 14, electrically contact positive and negative terminal receptors 56 and 58 of a light emitting diode (LED) 60. The LED 60 is of the surface mounted type, permitting the arrangement of shown in FIG. 5 and may comprise, for example, a device commercially available under Part No. KPT 2021HD from Kingbright Corporation of City of Industry, California. Such a LED is available in red, blue, green, amber and white. The invention is, however, not limited to such device.

The bead 54 of the medallion 18 includes a diametrical hole 62 forming a channel therethrough. To assemble, the LED 60 is inserted into the channel after insertion of the surface mounted LED 60 therein with positive and negative terminal receptors 56 and 58 facing opposed channel entrances. The exposed conductor 14 at the ends of the stripped coated conductor 12 are separately inserted into the ends of the channel to contact the LED 60. Once contact is made with one of the opposed terminals, an appropriate non-conductive adhesive, such as silicone glue, is injected into the channel and allowed to harden to maintain contact between that terminal and the conductor or wire 14. This process is repeated to obtain secure contact between the wire 14 and each of the terminal receptors 56 and 58, resulting in a simple, yet rugged configuration. The use of silicone glue assures that the channel will remain clear and in no way affect the appearance of the bead 54 when illuminated.

Employing a surface mounted LED 60 enables the use of a small bead-like medallion 18 that is illuminated from within. This is to be contrasted with illuminated medallion-type ornamentation that employs bullet mounted LEDs such at that taught in U.S. Pat. No. 6,122,933 issued to Stephen K. Ohlund on Sep. 26, 2000 for "Jewelry Piece". Such LEDs operate at a higher voltage (requiring the use of multiple batteries and thereby necessitating a bulkier clasp) and, as in the above patent, requiring an arrangement other than the simple and durable arrangement of the invention in which wires enter into the interior of a bead to contact opposite sides of a LED. This is due to the fact that bullet-mounted LEDs are bulkier (approximately 0.75 mm vs. 3 mm in cross section) than surface mounted LEDs and the output pins of such LEDs are parallel to one another, exiting the LED from the same side. Such terminal configuration prevents the mounting of such a source wholly within a small bead as in the invention. The mounting of the light source wholly within a relatively small bead 54 generates a more brilliant and dramatic effect than possible in devices limited to indirect illumination as a consequence of the use of bullet type LED sources such as that of U.S. Pat. No. 6,122,933.

When assembled, the necklace 10 (alternatively, a bracelet may by formed with a shortened coated conductor 12) is then operable as a piece of luminous jewelry with illumination emanating through the bead 54 of the medallion 18 since the LED 60 is in electrical contact with the battery 22 power supply through the conductor 14 when the clasp 20 is closed and secured as shown in FIG. 4.

While this invention has been described with reference to its presently-preferred embodiment, it is not limited thereto. Rather, the invention is limited only insofar as it is defined by the following set of patent claims and includes within its scope all equivalents thereof.

What is claimed is:

1. An article of jewelry comprising:

a) a flexible conductor having an exterior coating of non-conductive composition;

b) said conductor forming a loop having first and second internal discontinuities;

c) a clasp located within said first discontinuity;

d) a medallion located within said second discontinuity;

e) said medallion having a channel extending therethrough and adapted to receive said conductor;

f) said clasp includes a lower cap with an annular sidewall adapted to receive a battery, and an upper cap with a sidewall adapted to receive an electrode; and g) said lower cap annular sidewall is adapted to frictionally engage said upper cap sidewall and to contact a rim of said upper cap of said clasp, wherein said electrode is adapted to contact said battery upon said engagement.

2. The jewelry of claim 1, wherein said medallion is translucent.

3. The jewelry of claim 1, further comprising a tunnel extending through a sidewall of said lower cap.

4. The jewelry of claim 3, further comprising a distal end of said tunnel adapted to receive an electrode of said conductor in communication with said battery.

5. The jewelry of claim 1, further comprising a tunnel extending through said sidewall of said upper cap.

6. The jewelry of claim 5, further comprising a distal end of said tunnel adapted to receive an electrode of said conductor.

7. The jewelry of claim 1, further comprising a light emitting diode mounted within said channel of said medallion.

8. The jewelry of claim 7, wherein said conductor received within said channel of said medallion is in electrical communication with said light emitting diode.

9. The jewelry of claim 7, wherein said tight emitting diode is a surface mount light emitting diode.

10. The jewelry of claim 9, wherein said surface mount light emitting diode illuminates said medallion from an inside surface of said channel.

11. An article of jewelry comprising:

a) a flexible conductor having an exterior coating of non-conductive composition;

b) said conductor forming a loop having first and second internal discontinuities;

c) a clasp located within said first discontinuity;

d) a medallion located within said second discontinuity;

e) said medallion having a channel extending therethrough and adapted to receive said conductor;

f) said clasp having a lower cap with annular sidewall adapted to receive a battery, and an upper cap with an annular sidewall adapted to receive an electrode;

g) said lower cap annular sidewall is adapted to frictionally engage said upper cap sidewall and to contact a rim of said upper cap of said clasp, wherein said electrode is adapted to contact said battery upon said engagement; and h) a light emitting diode mounted within said channel of said medallion.

12. The jewelry of claim 11, wherein said light emitting diode illuminates said medallion from an inside surface of said channel.

13. The jewelry of claim 11, wherein said medallion is translucent.

* * * * *